US009797218B2

(12) United States Patent
Duphorne

(10) Patent No.: US 9,797,218 B2
(45) Date of Patent: Oct. 24, 2017

(54) WELLBORE SYSTEMS WITH HYDROCARBON LEAK DETECTION APPARATUS AND METHODS

(71) Applicant: Darin H. Duphorne, Houston, TX (US)

(72) Inventor: Darin H. Duphorne, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 547 days.

(21) Appl. No.: 14/278,236

(22) Filed: May 15, 2014

(65) Prior Publication Data

US 2015/0330214 A1 Nov. 19, 2015

(51) Int. Cl.

| | |
|---|---|
| ***E21B 33/134*** | (2006.01) |
| ***E21B 47/10*** | (2012.01) |
| ***E21B 33/13*** | (2006.01) |
| ***E21B 47/00*** | (2012.01) |
| *E21B 33/04* | (2006.01) |

(52) U.S. Cl.

CPC ..... *E21B 33/134* (2013.01); *E21B 33/13* (2013.01); *E21B 47/0005* (2013.01); *E21B 47/10* (2013.01); *E21B 47/1005* (2013.01); *E21B 47/1025* (2013.01); *E21B 33/04* (2013.01)

(58) Field of Classification Search

CPC .... E21B 33/134; E21B 47/10; E21B 47/1005; E21B 47/1025; E21B 47/0005; E21B 33/13; E21B 47/102

See application file for complete search history.

(56) References Cited

U.S. PATENT DOCUMENTS

| | | | | | |
|---|---|---|---|---|---|
| 3,489,219 | A * | 1/1970 | Higgins | E21B 33/143 | 166/253.1 |
| 4,120,166 | A * | 10/1978 | Brooks, Jr. | E02D 5/62 | 166/253.1 |
| 4,191,250 | A * | 3/1980 | Messenger | E21B 33/0355 | 166/253.1 |
| 4,475,591 | A * | 10/1984 | Cooke, Jr. | E21B 33/14 | 166/254.1 |
| 4,662,442 | A * | 5/1987 | Debreuille | E21B 47/06 | 166/250.01 |
| 5,323,856 | A * | 6/1994 | Davis | E21B 47/0905 | 166/253.1 |
| 5,467,823 | A * | 11/1995 | Babour | E21B 33/14 | 166/250.01 |
| 6,125,935 | A * | 10/2000 | Shahin, Jr. | E21B 33/14 | 166/250.14 |

(Continued)

*Primary Examiner* — Blake Michener
(74) *Attorney, Agent, or Firm* — Cantor Colburn LLP

(57) ABSTRACT

In one aspect, a wellbore system is disclosed that in one non-limiting embodiment includes a cement section in the wellbore formed to prevent flow of fluids including hydrocarbons through the cement section, a plug disposed uphole of the cement section to provide a space between the cement section and the plug and a sensor in the space for providing measurements relating to a parameter of interest. In one aspect, the parameter of interest may include one or more of presence and extent of a hydrocarbon, presence of moisture; pressure; and temperature. The system may further include a transmitter that transmits measurements from the sensor via a communication line or wirelessly to a receiver for processing the sensor measurements.

16 Claims, 2 Drawing Sheets

(56) References Cited

U.S. PATENT DOCUMENTS

| | | | | |
|---|---|---|---|---|
| 6,279,392 | B1 * | 8/2001 | Shahin, Jr. | C09K 8/42 166/250.14 |
| 6,408,943 | B1 * | 6/2002 | Schultz | E21B 47/01 166/250.01 |
| 6,994,167 | B2 * | 2/2006 | Ramos | C04B 24/003 166/173 |
| 7,219,729 | B2 * | 5/2007 | Bostick, III | E21B 21/08 166/242.1 |
| 7,673,682 | B2 * | 3/2010 | Daily | E21B 47/01 166/241.6 |
| 8,327,933 | B2 * | 12/2012 | Lynde | E21B 47/0005 166/177.4 |
| 2002/0149498 | A1 * | 10/2002 | Tabanou | E21B 7/061 340/854.5 |
| 2002/0179301 | A1 * | 12/2002 | Schultz | E21B 47/01 166/250.01 |
| 2003/0192695 | A1 * | 10/2003 | Dillenbeck | E21B 33/05 166/285 |
| 2010/0050905 | A1 * | 3/2010 | Lewis | C04B 28/02 106/638 |
| 2011/0186290 | A1 * | 8/2011 | Roddy | E21B 43/25 166/253.1 |
| 2013/0299165 | A1 * | 11/2013 | Crow | E21B 33/12 166/250.08 |
| 2014/0318783 | A1 * | 10/2014 | Martin | E21B 33/14 166/292 |
| 2016/0097274 | A1 * | 4/2016 | Duphorne | G01V 5/101 250/260 |

* cited by examiner

WELLBORE SYSTEMS WITH HYDROCARBON LEAK DETECTION APPARATUS AND METHODS

BACKGROUND

1. Field of the Disclosure

This disclosure relates generally to apparatus and methods for determining integrity of cement sections in wellbores.

2. Background of the Art

Wellbores are drilled in subsurface formations for the production of hydrocarbons (oil and gas). Modern wells can are drilled to great well depths, often more than 15,000 ft. Hydrocarbons are trapped in various traps or zones in the subsurface formations at different wellbore depths. Such zones are referred to as reservoirs or hydrocarbon-bearing formations or production zones. A casing is generally placed inside the wellbore and the space between the casing and the wellbore (annulus) is filled with cement. A production string or assembly containing a number of devices is placed inside the casing to perform a variety of operations downhole, including, but not limited to, fracturing, treatment and production of fluids from the formation to the surface. Once the well is no longer productive, a section of the well is filled or plugged with cement and abandoned. In some other cases, plugs made of other materials may be placed in the well prior to abandoning the well. It is important to determine that integrity of the cement plug or other plugs or prior to abandoning the well. Pressure tests are commonly performed to determine the integrity of the cement and other plugs. Such methods, however, do not provide long term information about the ongoing integrity of the cement plugs.

The disclosure herein provides apparatus and method for detecting leaks, such as of hydrocarbons, through the cement and other plugs to provide ongoing information about the integrity of the cement and other plugs.

SUMMARY

In one aspect, a wellbore system is disclosed that in one non-limiting embodiment includes a plug in the wellbore formed to prevent flow of fluids therethrough, including hydrocarbons, a seal disposed uphole of the cement section to provide a space between the plug and the seal and a sensor in the space for providing measurements relating to a parameter of interest. In one aspect, the parameter of interest may include one or more of: presence and extent of a hydrocarbon in the space; presence of moisture in the space; pressure; and temperature. The system may further include a transmitter that transmits measurements from the sensors via a communication link or wirelessly to a receiver for processing the sensor measurements.

In another aspect, a method of determining integrity of a plug or a cement section disposed in a wellbore is disclosed. The method, in one non-limiting embodiment includes: creating a sealed space uphole of the plug or the cement section; and placing a sensor in the space for providing measurements relating to a property of interest relating to the integrity of the plug or the cement section. The parameter of interest may be any suitable parameter including, but not limited to, presence and extent of a hydrocarbon in the space, moisture in the space, pressure, and temperature.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
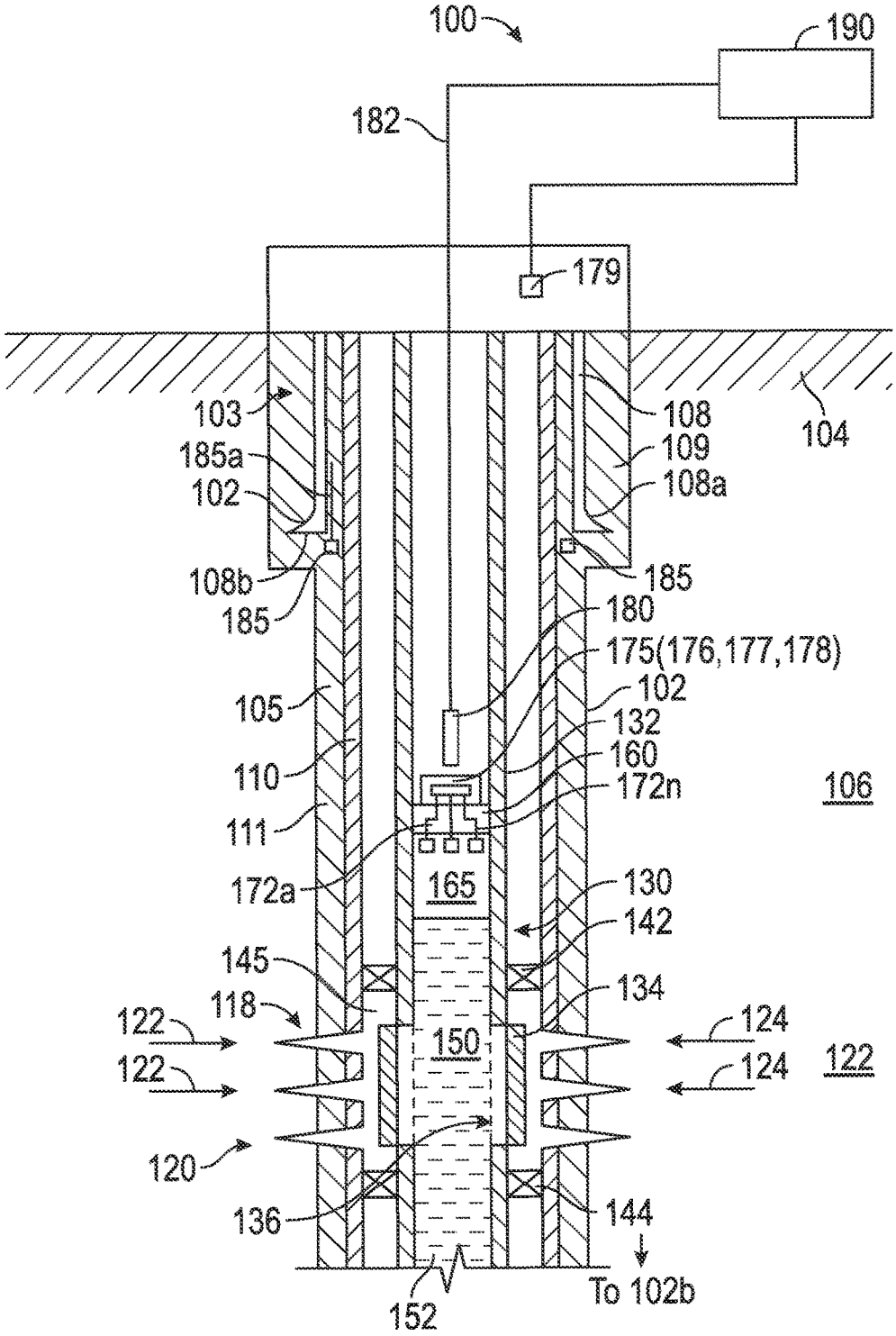
FIG. 1 shows a wellbore system that includes a sensor for detecting a parameter of interest in a space between a cement section or a plug and a seal or a second plug uphole of the cement section or the plug, according to one non-limiting embodiment of the disclosure.

FIG. 1 shows a wellbore system 100 that includes a wellbore 102 formed from a surface location 104 into a formation 106. An upper casing 108 placed in the wellbore extends to a first depth 102*a* and a lower casing 110 that runs from proximate the end 108*a* of the casing 108 to the bottom 102*b* of the wellbore. Cement 109 fills the annulus 103 between the casing 108 and the wellbore 102, while cement 111 fills the annulus 105 between the casing 110 and the wellbore 102. Perforations 118 through the casing 110 and the cement 111 at a production zone 120 allow formation fluid 122, including hydrocarbons, to flow from the formation 106 into the casing 110, as shown by arrows 124. A production string 130 is shown placed or deployed inside the casing 110 to produce the formation fluid 122 to the surface.

The production string 130 typically includes a tubular 132, one or more sand screens, such as screen 134, openings 136 in the tubular 132 and various other devices, such as valves (not shown), to transport the formation fluid 122 from the production zone 120 to the surface. Isolation devices, such as packers 142 and 144 to seal the annulus 145 between the casing 108 and the production string 130 above and below the production zone 120. Once the well 102 has lived its useful production life or for other reasons, it may be desirable to abandon the well. In such a case, in one non-limiting embodiment, a section 150 of the production string 130 may be filled with cement 152 (also referred to herein as the "cement plug") so as to prevent the formation fluid 122 from entering into the production tubing 132.

Still referring to FIG. 1, to provide information about the integrity of the cement section 150 over a relatively long time period, in one non-limiting embodiment, a seal, such as a plug 160 may be installed a certain distance above (uphole) of the cement section 150 to provide a space 165 (which may be a sealed space) between the cement section 150 and the plug 160. One or more sensors, such as sensors 172*a*, 172*b*, through 172*n* may be placed in the space 165 to provide measurements (information, data, signals etc.) relating to one or more parameters of interest. The parameters of interest may include, but are not limited to, presence and extent of a chemical, such as a hydrocarbon, moisture (water), pressure and temperature. The sensors 172*a*-172*n* may include, but are not limited to, a chemical sensor that provides measurements relating to a chemical, such as a hydrocarbon, a moisture sensor, a pressure sensor and a temperature sensor.

Still referring to FIG. 1, in one embodiment, one or more of the sensors 172*a*-172*n* may be attached to the seal 160 so that such sensors are exposed to the space 165. Communication links (electrical conductors, optical fibers, etc.) 172*a*-172*n* respectively for sensors 172*a*-172*n*, may be run through the seal 160 to a circuit 175 above (uphole) of the seal 160 or may be integral to the seal 160. The circuit 175, in one non-limiting embodiment, may include a conditioning circuit 176 to preprocess the signal received from the sensors 172*a*-172*n* and may include a controller (such as a microprocessor) 177 to process the signals from the circuit 176 or the sensors to provide the measurements of the parameters of interest in accordance with the instructions (programs) stored in a storage device 178. The storage device may also store the sensor measurements and/or parameter of interest determined by the controller 177 for later retrieval or transmission to another device or location. In another aspect, the circuit 175 may include a transmitter 179*a* for transmitting the sensor measurements and/or the parameters of interest or any other desired information to a remote receiver, such as receiver 179*b* at or near the surface 104. In one aspect, the transmitter 179*a* may be an acoustic transmitter that transmits signals to a remote receiver through a fluid 123 above the plug 160 or transmits signals via another suitable wireless telemetry method. In one embodiment, the circuit 175 may be programmed to wake-up or activate a sensor to obtain measurements and transmit such information to the surface periodically or when such measurements do not meet a criterion. In another embodiment, the circuit 175 may be programmed to transmit sensor information periodically. In another embodiment, a receiver 180 may be conveyed into the wellbore 102 on a conveying member 182, such as a wire line, slick line or coiled tubing to retrieve the information from the circuit 175. In one aspect, the receiver may wake-up or activate the circuit 179 to wirelessly receive the information from the circuit 175 or by making an electrical connection with the circuit 175. Any other known method and apparatus may also be utilized to retrieve the sensor information. A controller 190 at the surface may be provided to process sensor measurements received at the surface and to control one or more operation of the sensors 172*a*-172*n* and the circuit 175.

Still referring to FIG. 1, in another non-limiting embodiment, one or more sensors 185 may be deployed at one or more locations in an annulus, such as annulus 103 and/or 105 or at another location that may be prone to leaks. In one aspect sensors 185 may be placed in the annulus 103 during or before deployment of the casing 110 and before cementing the annulus 103. Sensors 185 may be placed in a container with the sensors exposed to their surrounding for making measurements. The sensors 185 may include a circuit, such as circuit 175 that wirelessly transmitter signals to the surface receiver 179*b*. Alternatively, communication lines 185*a* may be run from the sensors 185 to a surface controller 190 or to a remote station for remotely monitoring the parameters of interest. Such sensors may also be placed at any other location in the wellbore for monitoring the parameters of interest over a time period. In aspects, power to the sensors 172*a*-172*n*, 185 and circuit 175 may be provided with batteries placed in the circuits, which batteries may be rechargeable by a conveying member, such as member 182. In another embodiment, instead of filling the cement, a plug made from a suitable material, such as an elastomeric material, may be placed in the wellbore to seal an area below such a plug. In such cases, the plug 160 may be disposed uphole of such a seal to detect the presence of a parameter of interest relating to the integrity of such plug, in the manner described above in relation to the cement section. In other embodiment, the plug 160 may not provide a sealed space, but the sensor 150 still may provide measurements of a parameter of interest relating to the integrity of the cement plug or such other plug.

Figure 2:
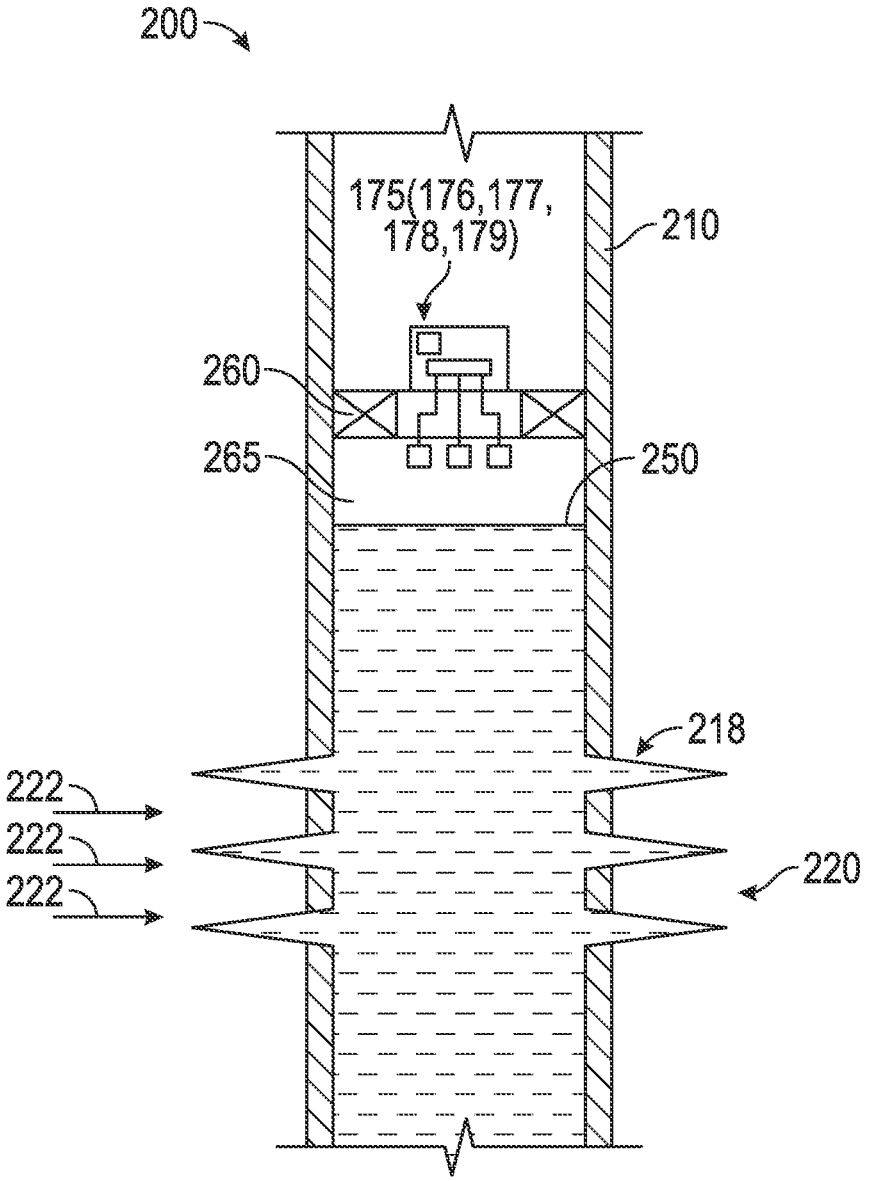
FIG. 2 shows a wellbore system without a production string in which sensors are placed in a space between a cement section and a plug in a manner shown in FIG. 1.

FIG. 2 shows a wellbore system 200 that does not include a production string, such as string 160 shown in FIG. 1. Referring to FIGS. 1 and 2, the wellbore system 200 is shown to include a casing 210 with perforations 218 at a production zone 220. In such a well system, a cement section 250 may be provided in the casing to prevent a formation fluid 222 from flowing from 220 into the casing 210. A seal or plug 260 containing sensors 172*a*-172*n* and circuit 175 may be deployed above the cement section 250 with the sensors exposed to a space between the cement section 250 and the seal 260. The sensor information may be obtained and processed in the manner described in reference to FIG. 1.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A wellbore system, comprising:

a cement section in the wellbore to prevent flow of fluids including hydrocarbons through the cement section;

a seal plug disposed uphole of the cement section to provide a non-barrier space between the cement section and the seal plug;

a sensor in the non-barrier space for providing measurements relating to a parameter of interest;

a circuit uphole of the seal that receives a signal from the sensor via a wired communication link through the seal; and a receiver conveyed into the wellbore on a conveying member to retrieve information from the circuit.

2. The wellbore system of claim 1, wherein the parameter of interest is selected from a group consisting of: presence of a hydrocarbon; presence of water; pressure; and temperature.

3. The wellbore system of claim 1, wherein the wired communication link is one of: a wire; and an optical fiber.

4. The wellbore system of claim 3, wherein the circuit further comprises a transmitter that transmits signals wirelessly to the receiver conveyed into the wellbore.

5. The wellbore system of claim 1, wherein the sensor is selected from a group consisting of a: chemical sensor; water detection sensor; pressure sensor; and temperature sensor.

6. The wellbore system of claim 1, wherein the sensor is permanently installed in the wellbore for providing the measurements relating to the parameter of interest.

7. A method of determining integrity of a cement section formed in a wellbore, the method comprising:

placing a seal plug uphole of the cement section to provide a non-barrier space between the cement section and the seal plug;

placing a sensor in the non-barrier space for providing measurements relating to a property of interest relating to a leak through the cement section;

receiving a signal from the sensor at a circuit uphole of the seal via a wired communication link through the seal; and conveying a receiver into the wellbore on a conveying member to retrieve the signal from the circuit.

8. The method of claim 7, wherein the parameter of interest is selected from a group consisting of: presence of a hydrocarbon; presence of water; pressure; and temperature.

9. The method of claim 7 further comprising transmitting signals wirelessly from the circuit to the receiver that is located in the wellbore.

10. The method of claim 9, wherein receiving the signals from the sensor at the circuit comprises receiving the signals by one of: a wire; and an optical fiber.

11. The well bore system of claim 9 further comprising a processor for determining the parameter of interest from the measurements transmitted by the circuit.

12. The method of claim 7, wherein the sensor is selected from a group consisting of a: chemical sensor; water detection sensor; pressure sensor; and temperature sensor.

13. The method of claim 7, wherein placing the sensor in the non-barrier space comprises placing the sensor permanently in the non-barrier space.

14. A wellbore system, comprising:

a first seal plug to seal a section of the wellbore to prevent flow of fluids including hydrocarbons through the first seal plug;

a second seal plug uphole of the first seal plug to provide a non-barrier space between the first seal plug and the second seal plug;

a sensor in the non-barrier space for providing measurements relating to a parameter of interest relating to integrity of the first plug;

a circuit uphole of the second seal plug that receives signals from the sensor via a wired communication link through the seal; and a receiver conveyed into the wellbore on a conveying member to retrieve information from the circuit.

15. The apparatus of claim 14, wherein the first seal plug includes one of: cement; and an elastomeric material.

16. The apparatus of claim 15 further comprising a processor that processes measurements from the sensor to provide a measure of a leak of a hydrocarbon through the first seal plug.

* * * * *